United States Patent [19]

Chansavoir et al.

[11] Patent Number: 5,027,492

[45] Date of Patent: Jul. 2, 1991

[54] DEVICE FOR FITTING TEMPORARY SECURING MEANS TO A WORKPIECE

[75] Inventors: Alain Chansavoir, Luzancy; Christian Joncour, Saint Maurice; Michel Nauche, Soisy-sous-Montmorency, all of France

[73] Assignee: Essilor International Cie Geneale d'Optique, Soisy Sous Montmorency, France

[21] Appl. No.: 557,020

[22] Filed: Jul. 25, 1990

[30] Foreign Application Priority Data

Aug. 9, 1989 [FR] France ..... 89 10714

[51] Int. Cl.[5] ..... B25B 27/14

[52] U.S. Cl. ..... 29/281.5

[58] Field of Search ..... 269/21; 53/323, 319, 53/368; 294/62, 64.1, 902; 29/281.5; 51/216 LP, 217 L

[56] References Cited

U.S. PATENT DOCUMENTS

| | | | |
|---|---|---|---|
| 522,808 | 7/1894 | Tagliabue | 53/323 |
| 1,727,889 | 9/1929 | McCabe . | |
| 3,909,055 | 9/1975 | Koppel | 294/64.1 |
| 4,201,408 | 5/1980 | Tressel | 294/1.2 |
| 4,378,126 | 3/1983 | Procenko | 294/1.2 |

FOREIGN PATENT DOCUMENTS

| | | |
|---|---|---|
| 2545948 | 4/1977 | Fed. Rep. of Germany . |
| 2613268 | 10/1988 | France . |

*Primary Examiner*—Robert C. Watson

*Attorney, Agent, or Firm*—Charles A. Brown

[57] ABSTRACT

A device for fitting a handling block to an eyeglass lens to which the handling block adheres temporarily includes a receptacle into which the handling block is push-fitted. An ejector system associated with the receptacle facilitates disengagement of the handling block from the receptacle after it is fitted to the lens. This system is operative outside the receptacle and engages operatively on the eyeglass lens concerned. It comprises two ejector fingers movable parallel to the axis of the receptacle against return springs.

9 Claims, 1 Drawing Sheet

DEVICE FOR FITTING TEMPORARY SECURING MEANS TO A WORKPIECE

BACKGROUND OF THE INVENTION

1. Field of the Invention

The present invention is generally concerned with fitting to an eyeglass lens to be worked on, for example to be trimmed, a block referred to hereinafter for convenience as a handling block which is adapted to adhere to the eyeglass lens temporarily, for example by means of a sucker, and to enable the lens to be fitted and locked into position on a machine for carrying out the necessary work.

It is more particularly directed to the situation where this fitting is effected by means of a device including a receptacle adapted to have the handling block push-fitted into it.

2. Description of the Prior Art

This receptacle is mounted on an arm, for example, which is mobile, possibly among other directions, perpendicularly to a plate on which the eyeglass lens is placed.

During a first part of its movement the arm moves towards the plate and places the handling block onto the eyeglass lens.

In a second stage it moves away from the plate.

In some applications at least it is required to leave the eyeglass frame fitted with the handling block behind on this plate.

To this end it has been proposed to associate with it ejector means to facilitate the disengagement of the handling block from its receptacle once fitted to the lens.

At present these ejector means are operative within the receptacle and are designed to act on the handling block.

Experience shows that in practice these ejector means are not totally effective and it is not rare for the arm to entrain with it when it is retracted the handling block and therefore the eyeglass lens adhering to the latter.

A general object of the present invention is an arrangement to avoid this risk.

SUMMARY OF THE INVENTION

The present invention consist in a device for fitting a handling block to an eyeglass lens to which the handling block is adapted to adhere temporarily, the device comprising a receptacle adapted to have said handling block push-fitted into it and ejector means associated with said receptacle adapted to facilitate disengagement of said handling block from said receptacle after it is fitted to the lens, operative outside the receptacle and adapted to engage operatively on the eyeglass lens concerned.

These ejector means therefore benefit advantageously from a non-negligible lever arm which, by virtue of the resulting multiplication effect, guarantees their effective operation.

In a preferred embodiment they in practice comprise two ejector fingers each movable against return spring means in a direction generally parallel to the axis of the receptacle, being disposed on respective sides of the axis of the receptacle and carried by pivoting arms which are part of a common swing-arm.

In this way the effects of any (in practice frequent) eccentricity of the handling block relative to geometrical axis of the eyeglass lens are systematically compensated for.

The ejector means in accordance with the invention hold the eyeglass lens elastically against the plate which carries it when the arm to which they are fitted moves away from the plate, the forces employed being determined in consequence of this so that the handling block, retained by the eyeglass lens, is disengaged from its receptacle and therefore from the arm.

The characteristics and advantages of the invention will emerge from the following description given by way of example with reference to the appended diagrammatic drawings.

DETAILED DESCRIPTION OF THE INVENTION

Figure 1:
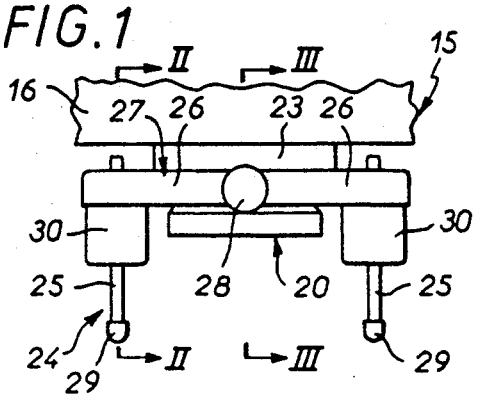
FIG. 1 is a partial view in elevation of a device in accordance with invention, in its fitting configuration.

As shown in the figures, and more specifically in FIGS. 4A through 4E, the overall problem is to attach to an eyeglass lens 10 placed on a plate 11 a handling block 12 comprising, for this purpose, a sucker 13, for example.

In the embodiment shown the handling block 12 has, in addition to the sucker 13, a cylindrical end-piece 14, with a circular contour, for example, enabling it to be grasped.

The device 15 used to fit a handling block 12 of this kind to a lens will not be described in complete detail here. Only those parts of it necessary to an understanding of the invention will be described.

Suffice to say that in the embodiment shown the device 15 includes an arm 16 which is mobile and in at least an end phase of its movement travels in a straight line substantially perpendicular to the plate 11.

The arm 16 includes a receptacle 18 into which the end-piece 14 of the handling block 12 can be push-fitted.

In practice this is a blind cylindrical hole with a circular contour complementary to that of the end-piece 14.

In the embodiment shown the receptacle 18 is formed in an intermediate support 20 attached by an end-piece 21 to the arm 16 by means of a housing 22 recessed into a boss 23 of the latter and locked into position in the housing 22, for example by grubscrews (not shown).

The receptacle 18 is associated with ejector means 24 adapted to facilitate removal of the handling block 12 from the receptacle 18 after fitting it to the lens.

In accordance with the invention the ejector means 24 operate outside the receptacle 18 and are adapted to operatively engage the eyeglass lens 10 to processed.

Figure 2:
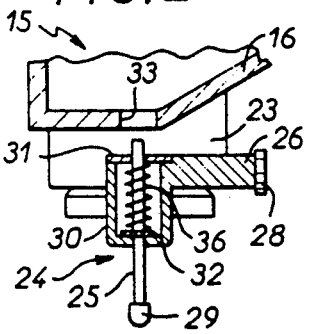
FIGS. 2 and 3 are partial views of it in cross-section on the respective lines II—II and III—III in FIG. 1.
Figure 3:
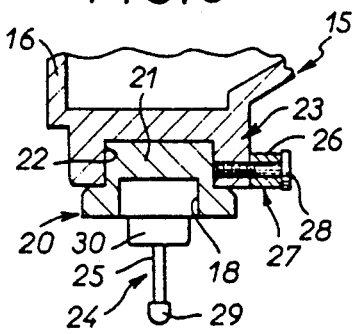

To this end they comprise at least one ejector finger 25 which is mobile against return spring means, in practice a simple helical coil spring 36, generally parallel to the axis of the receptacle 18. The finger is urged at all times towards a position (FIGS. 1 through 3) in which its free end extends substantially beyond the receptacle 18, in practice substantially beyond a handling block 12 when the handling block 12 has its end-piece 14 engaged with the receptacle 18 (FIG. 4A).

In the embodiment shown there are two ejector fingers 25 spaced from and on respective opposite sides of the receptacle 18. Each is carried by an arm 26 pivoted to the arm 16, the two arms 26 corresponding to the respective ejector fingers 25 being parts of a single swing-arm 27 pivoted to the arm 16 by a spindle 28 in its middle part and perpendicular to the axis of the receptacle 18.

In this embodiment each ejector finger 25 is in the form of a simple rod with a head 29 at its free end adapted to cushion its contact with the eyeglass lens 10.

The two ejector fingers 25 are symmetrically disposed relative to each other, as are the arms 26 carrying them.

In practice the spring 36 constituting the return spring means associated with an ejector finger 25 is disposed around the latter in a housing provided for this purpose in a boss 30 projecting from the corresponding arm 26 and bears against a cover 31 closing the housing 30. It carries a split spring washer 32 fastened to the ejector finger 25 by inserting it into a groove provided in the latter for this purpose.

In the embodiment shown there is a hole 33 in the arm 16 in line with each of the ejector fingers 25, to enable them to move.

At the start of a working cycle (FIG. 4A) the arm 16 carrying a handling block 12 moves towards the plate 11, perpendicularly to it and therefore parallel to the axis of the corresponding receptacle 18, as shown by the arrow F in FIG. 4A.

It follows from what has been said already that the heads 29 of the ejector fingers 25 then extend forwardly of the sucker 13 on the handling block 12.

Figure 4C:
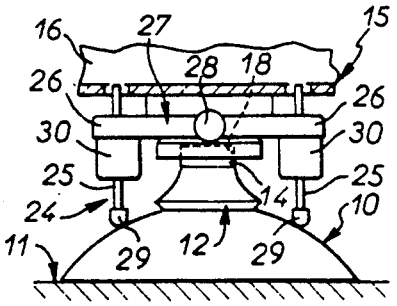
FIGS. 4A through 4E are partial views in elevation similar to that of FIG. 1, to a smaller scale and partially cut away in some instances, showing various successive phases of fitting a holding block to an eyeglass lens using this device.
Figure 4A:
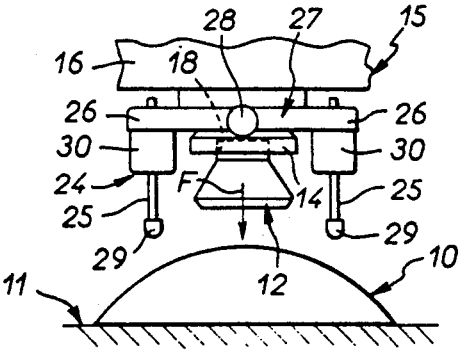
Figure 4D:
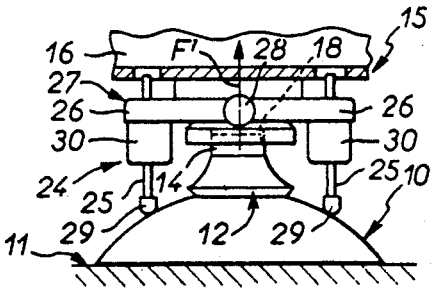
Figure 4B:
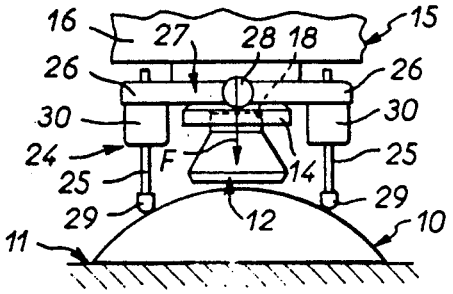

It is therefore the heads 29 of the ejector fingers 25 which first come into contact with the eyeglass lens 10 (FIG. 4B).

From this time the ejector fingers 25 retract against their springs while, as shown by the arrow F in FIG. 4B, the movement of the arm 16 towards the plate 11 continues until, after the sucker 13 comes into contact with the eyeglass lens 10, axial crushing of the sucker 13 against the eyeglass lens is sufficient for it to be certain that the sucker will adhere to the lens (FIG. 4C).

Figure 4E:
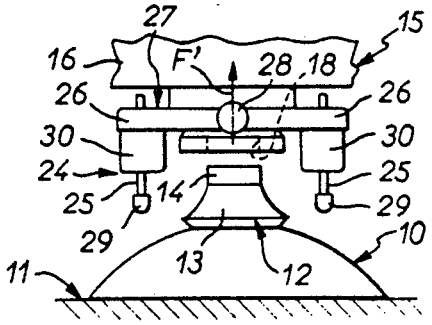

Its motion being reversed, the arm 16 then moves away from the plate 11, as schematically represented by the arrow F' in FIGS. 4D and 4E.

Acted on by the springs 36 constituting their return spring means, the ejector fingers 25 are still in contact with the eyeglass lens 10 and hold it against the plate 11 while, the forces deployed being appropriately determined, the handling block 12 is retained by the eyeglass lens 10 and does not follow this withdrawal movement of the arm 16.

For this it is sufficient for the spring force applied to the eyeglass lens 10 by the ejector fingers 25 to have an axial component greater than the friction force between the end-piece 14 of the handling block 12 and the corresponding side wall of the receptacle 18 and for the adhesion force between the sucker 13 of the handling block 12 and the eyeglass lens 10 to have an axial component greater than the latter force.

Thus as the arm 16 is retracted the handling block 12 progressively disengaged form the receptacle 18 (FIG. 4D) until it escapes from it completely (FIG. 4E).

Conjointly, the ejector fingers 25 progressively return to their original position.

In the foregoing it has been assumed that the handling block 12 was to be placed on the geometrical axis of the eyeglass lens 10.

This is not necessarily so, however.

Figure 5:
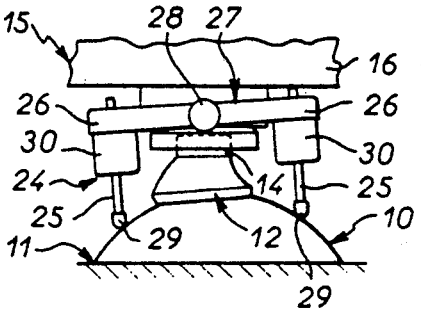
FIG. 5 is a partial view in elevation similar to that of FIG. 4D for an alternative embodiment of the device.

To the contrary, it may frequently need to be placed off-center relative to the geometrical axis of the eyeglass lens 10, as shown in FIG. 5.

In this case the first ejector finger 25 to come into contact with the eyeglass lens 10 causes tilting of the swing-arm 27 which causes the second ejector 15 to come also into contact with the lens.

Of course, the present invention is not limited to the embodiment described and shown but encompasses any variant execution thereof.

We claim:

1. Device for fitting a handling block to an eyeglass lens to which said handling block is adapted to adhere temporarily, said device comprising a receptacle adapted to have said handling block push-fitted into it and ejector means associated with said receptacle adapted to facilitate disengagement of said handling block from said receptacle after it is fitted to said lens, operative outside said receptacle and adapted to engage operatively on the eyeglass lens concerned, said ejector means comprising at least one ejector finger movable against return spring means substantially parallel to the axis of said receptacle urged at all times by said return spring means towards a position in which its free end extends substantially beyond said receptacle, and said ejector finger being carried by a pivoting arm.

2. Device according to claim 1 comprising two said ejectors fingers disposed on respective sides of the axis of said receptacle, and wherein two corresponding pivoting arms carrying said two ejector fingers are parts of a common swing-arm.

3. Handling block fitting device for an eyeglass lens, comprising means defining a receptacle movable toward and away from a bearing surface for receiving an eyeglass lens, said means defining a receptacle being adapted to temporarily secure a handling block therein, said handling block having means for adhering to the eyeglass lens and for facilitating handling thereof, and ejector means for facilitating the disengagement of said handling block from said means defining a receptacle once said handling block is fitted on the eyeglass lens, said ejector means being disposed outside said means defining a receptacle and being adapted to bear against the eyeglass lens as the means defining a receptacle moves away from the bearing surface and the eyeglass lens thereon.

4. Device according to claim 3, wherein said handling block is received with frictional engagement in said means defining a receptacle, whereby said ejector means overcomes the frictional engagement for disengagement of said handling block.

5. Device according to claim 3, wherein said receptacle has an axis, said ejector means comprising at least one ejector finger, said ejector finger having a free end, said ejector finger free end extending substantially beyond said means defining a receptacle in an extended position of said ejector finger, said spring means resiliently urging said ejector finger toward the extended position.

6. Device according to claim 5, wherein said ejector finger has an at least partially retracted position when said holding block is brought into adhering engagement with the eyeglass lens, loading of the spring means in said at least partially retracted position being adapted to overcome forces temporarily securing said holding block in said means defining a receptacle as said means defining said receptacle moves away from the bearing surface.

7. Device according to claim 3, wherein said ejector finger is carried by a pivoting arm.

8. Device according to claim 3, wherein two said ejector fingers are disposed on respective sides of an axis of said means defining a receptacle, said ejector fingers being carried on a common swing-arm pivotally mounted therebetween.

9. Device according to claim 3, wherein said means for adhering to the eyeglass lens comprises a sucker.

* * * * *